United States Patent [19]

Noto La Diega

[11] 4,359,177

[45] Nov. 16, 1982

[54] REVOLVING TURRET FOR CONTINUOUS CASTING, WITH INDEPENDENT ARMS, AND ECCENTRIC LOAD COMPENSATION

[75] Inventor: Michele Noto La Diega, Genoa, Italy

[73] Assignee: Costruzioni Meccaniche Industriali Genovesi, Italy

[21] Appl. No.: 163,408

[22] Filed: Jun. 26, 1980

[51] Int. Cl.[3] ..... B62D 41/00; B62D 41/12

[52] U.S. Cl. ..... 222/591; 212/195; 222/168.5; 164/335

[58] Field of Search ..... 164/335; 212/195; 222/591, 606, 607, 168, 168.5

[56] References Cited

U.S. PATENT DOCUMENTS

| | | | |
|---|---|---|---|
| 3,556,349 | 1/1971 | Niskovskikh et al. | 222/168.5 |
| 3,717,331 | 2/1973 | Simons | 222/607 X |
| 3,817,318 | 6/1974 | Greenberger et al. | 222/607 X |
| 3,894,576 | 7/1975 | Schoffmann | 222/607 X |
| 4,121,742 | 10/1978 | Biricz et al. | 222/591 |

*Primary Examiner*—David A. Scherbel

*Attorney, Agent, or Firm*—Robert E. Burns; Emmanuel J. Lobato; Bruce L. Adams

[57] ABSTRACT

A continuous casting revolving tower, with independent arms, of the type having a central support column against which lies a turret supported for rotation about a vertical axis, and a pair of arms, at the end of each of which is assembled a ladle, liftable and respectively lowerable within predetermined limits. Driving and sliding means to lift and lower the revolving turret with respect to the support column. Each of the two ladles is assembled in a vertically fixed position at a respective end of the arms which, though independently rotatable with respect to said turret, are integral with it in its vertical movement.

2 Claims, 8 Drawing Figures

REVOLVING TURRET FOR CONTINUOUS CASTING, WITH INDEPENDENT ARMS, AND ECCENTRIC LOAD COMPENSATION

BACKGROUND OF THE INVENTION

The turrets for continuous casting of known type generally consist of a vertical support element at the upper end of which there are two support arms, revolving about a vertical axis, for two corresponding ladles.

As in the continuous casting process it is necessary to lift or lower each of said ladles, in the known devices of this type the lifting and lowering means of each of the two ladles are arranged at the end of said arms, the vertical position of which is therefore fixed, while, as said before, they can revolve about a vertical axis.

The eccentric arrangement of the ladle weights cause turnover moments, which are supported by a vertical support column. It is evident that an increase of turnover moments and of lifting heights must correspond to an increase of the resisting moment of said vertical column, and particularly of the inertial moment, in order to constrain the structure elasticity. Consequently, the sturdiness of the whole device and the resistance to wear of mechanical members subjected to relative sliding must correspondingly increase.

OBJECTS OF THE INVENTION

The object of the present invention is to take away from the turret support column the function of resisting the turnover moment caused by load eccentricity, correspondingly lightening the overloads of the sliding members which allow for the lifting and lowering of the platform along the vertical support column.

This was obtained first of all by lifting and lowering the two ladles integrally with their respective arms and with the turret.

Therefore, in a way per se known, the two arms shall be rotatable with respect to each other, and each with respect to the common support turret.

Moreover, the turret according to the invention is supported by a first set of hydraulic pistons whereas the side-skidding moment, due to eccentric loads, is balanced by a second set of double-effect hydraulic pistons, suitably connected to one another.

DESCRIPTION OF A PREFERRED EMBODIMENTS

Figure 1:
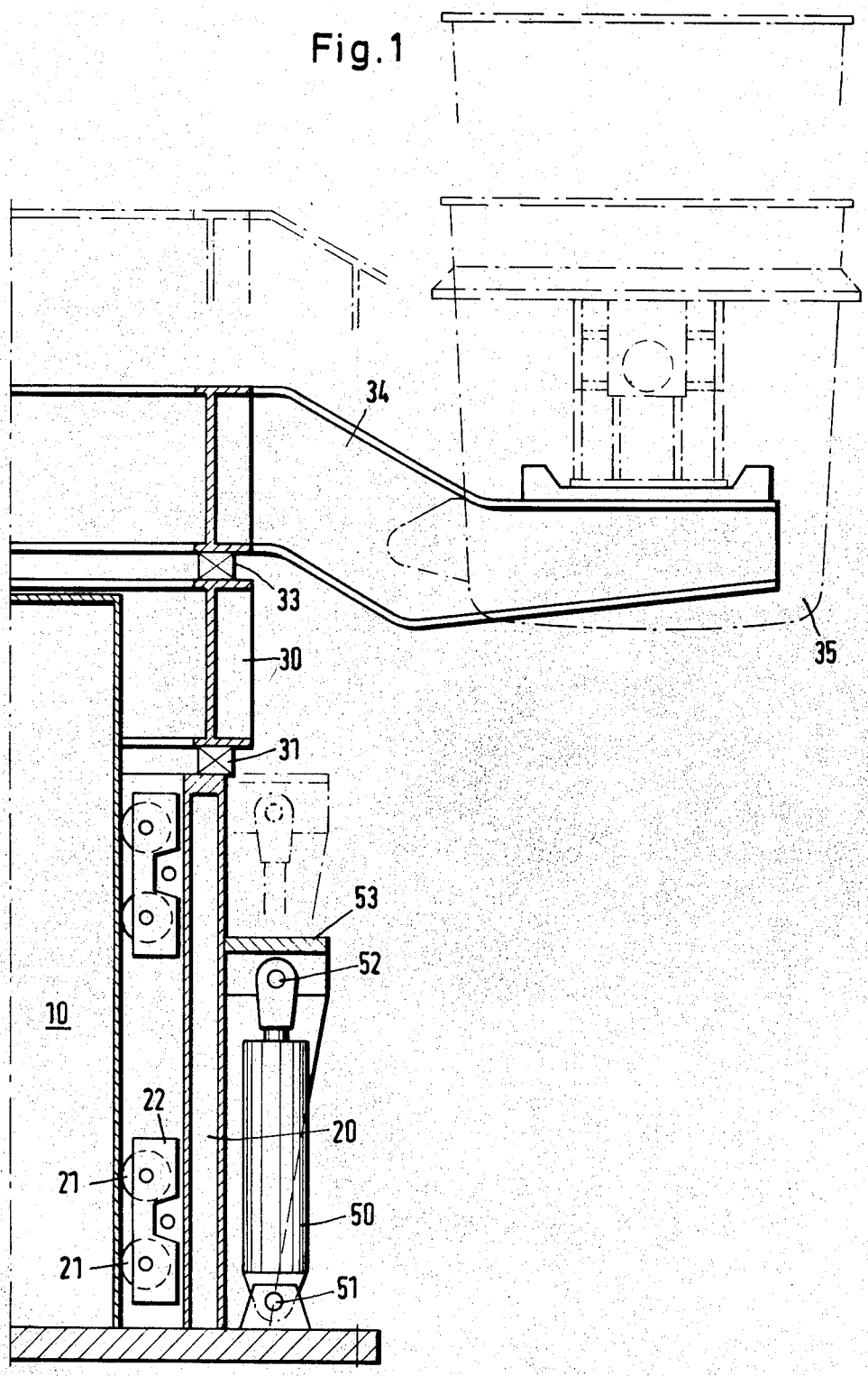
FIG. 1 is a side half-view of a turret according to the present invention.
Figure 2:
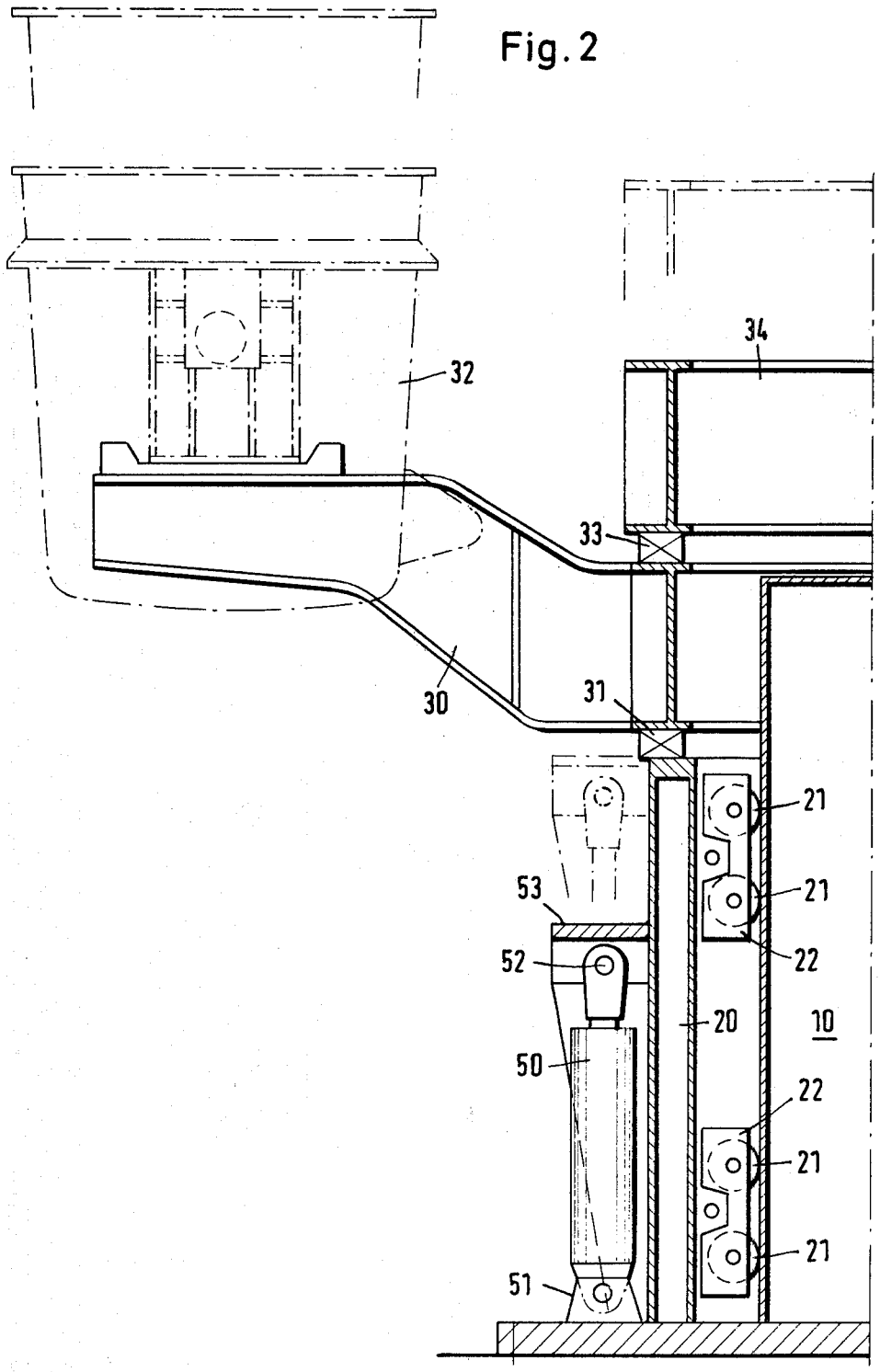
FIG. 2 is a side half-view similar to FIG. 1, but relating to the second half of the turret, so that the two half-views of FIGS. 1 and 2 form a complete side view.
Figure 3:
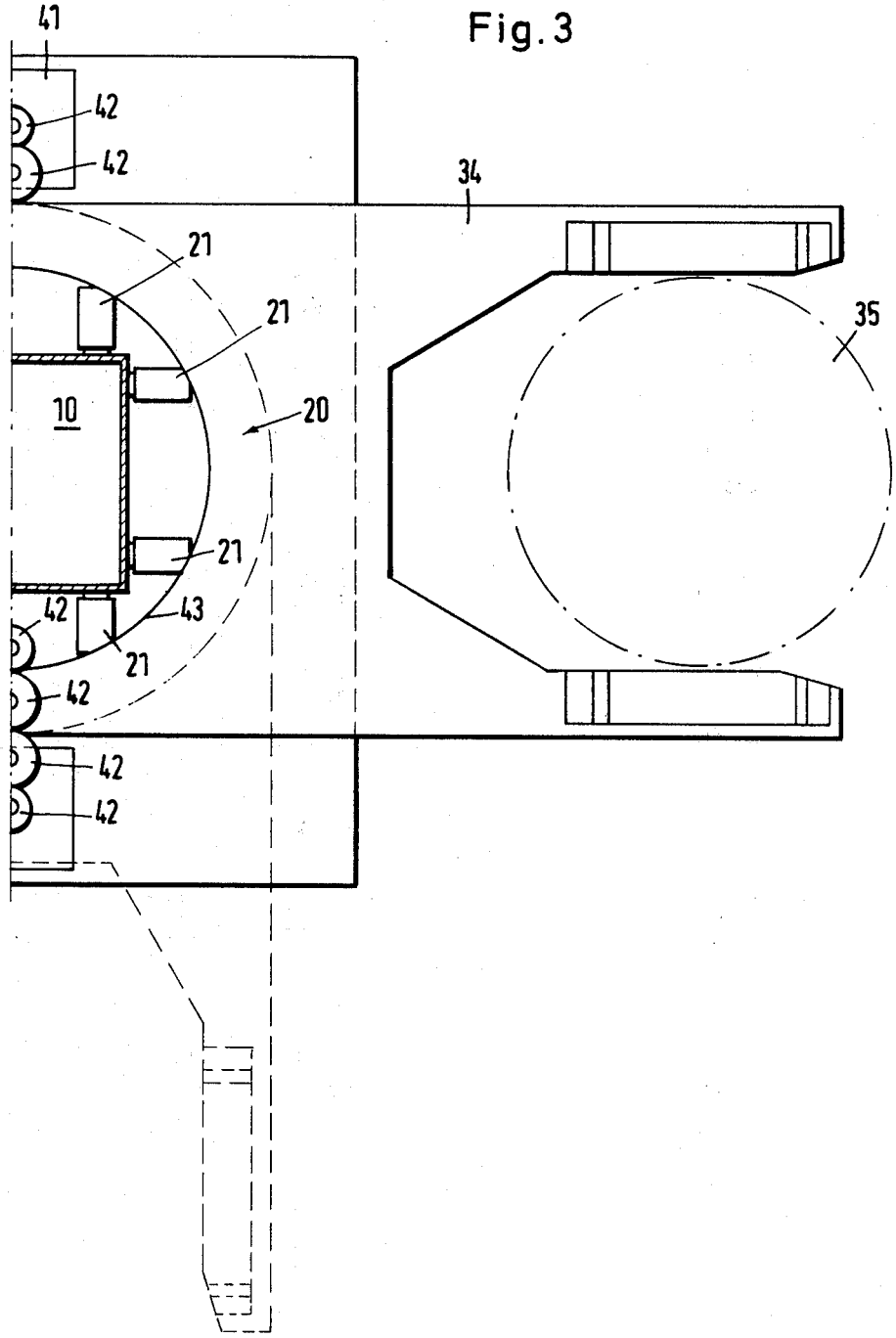
FIGS. 3 and 4 each are a top half-view of said turret, so that they also jointly form a complete view of the top of the turret according to the present invention.
Figure 4:
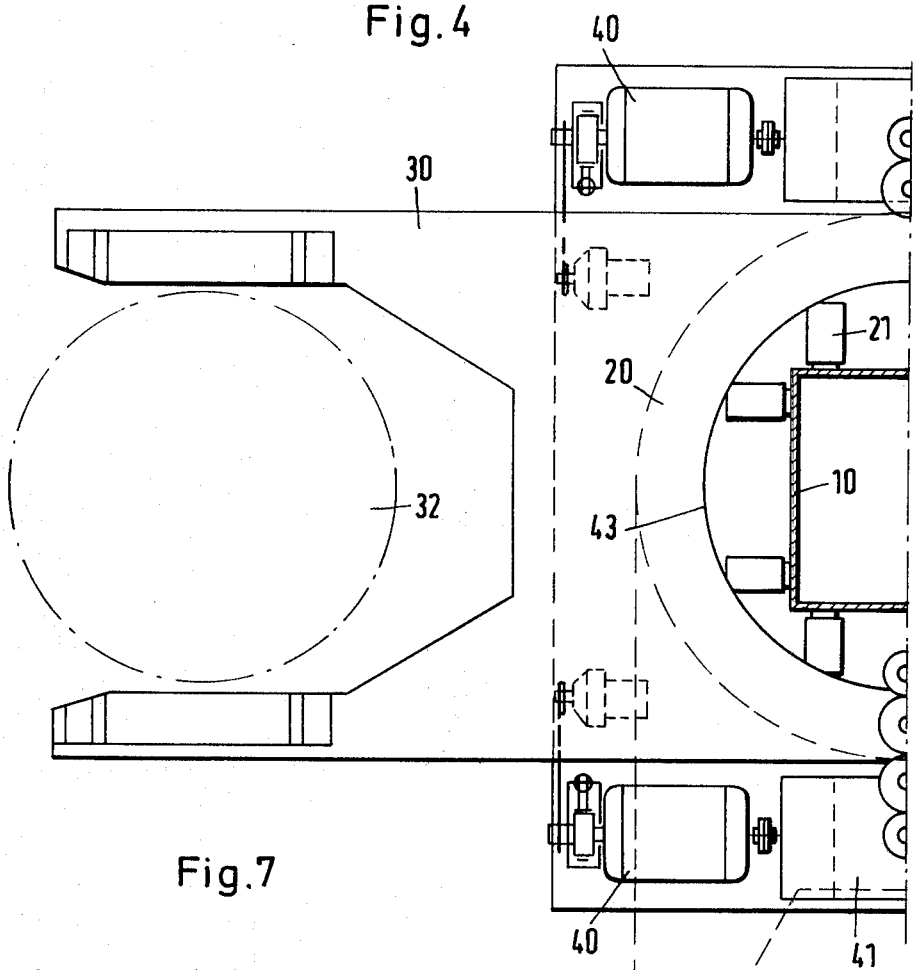

With particular reference to the drawings, 10 indicates a central support column, in this case with a square section, anchored to the foundations of the tower driving machine. Except in the case that the hydraulic system breaks down, said column, as will be later explained, is not intended to oppose the overturn moment brought about by load eccentricity.

Around central support column 10 there is vertically slidable-turret 20 consisting of a substantially tubular structure, on the inner surface of which are arranged sixteen bascules, i.e. sixteen pairs of sliding wheels 21 arranged in oscillating supports 22. On the upper end of turret 20 lies a first arm 30 for supporting overhanging ladle 32; said arm 30 is angularly rotatable through rotating means 31.

On said first arm 30 is assembled, and equally rotatable by means of rotating means 33, the second arm 34 at the end of which the second ladle 35 is supported.

The independent rotation movement of the two arms 30 and 34 is obtained, in a way per se known, with driving means 40, through geared reduction trunks 41 and geared wheels 42, shown only schematically, or through crown wheels 43 integral with each of the arms 30 and 34.

Turret 20, which is liftable and lowerable, but not revolvable, is supported by four simple effect hydraulic pistons 50, driven in parallel by a conventional hydraulic engine, and articulated below at 51 at the base and above at 52 to an annular flange 53 integral with turret 20.

The sliding of turret 20 over column 10 is achieved by means of sixteen pairs of wheels 21, which however do not have to bear the loads deriving from the overturning moments caused by eccentric loads due to arms 30 and 34, and the ladles carried by the arms.

Figure 7:
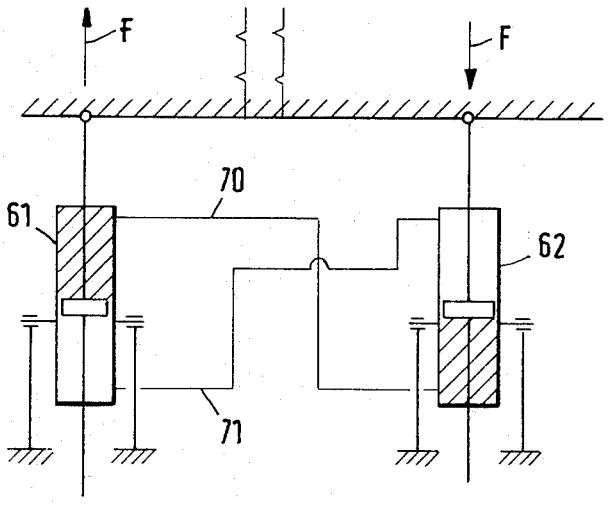
FIG. 7 shows hydraulic connection scheme of two opposed hydraulic pistons of the second set.
Figure 5:
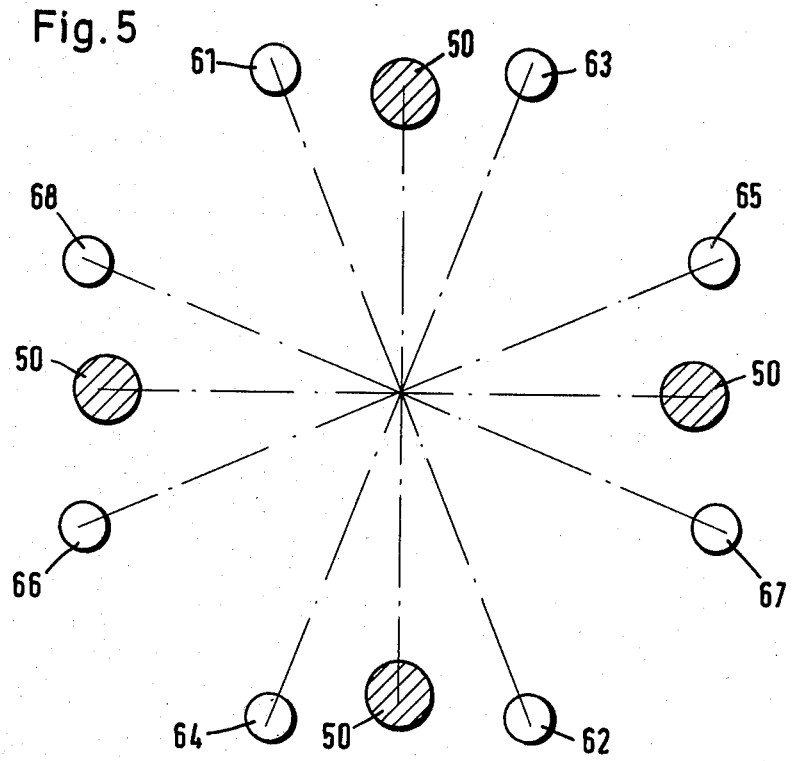
FIG. 5 is a diagram of the hydraulic jack positions in the present invention.
Figure 6:
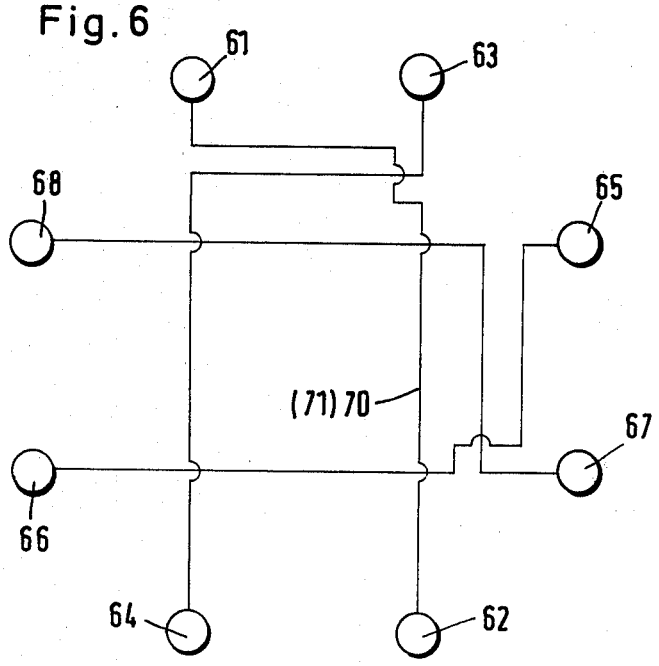
FIG. 6 is a schematic diagram similar to FIG. 5 showing the interconnection of the second set of hydraulic pistons.

To this purpose, indeed, there has been provided a second set of hydraulic pistons 61, 62, 63, 64, 65, 66, 67, 68 which, two by two, have the upper chamber of the one connected to the lower chamber of the other, as shown in diagramme in FIG. 7. In the presence of a side-skid moment diagramatically shown by arrows F on FIG. 7, the lower chamber of piston 62, on one hand, and the upper chamber of piston 61, on the other hand, are put under pressure, in view of the fact that said two chambers are in communication with each other through line 70. Similarly the two other opposing chambers of said pistons are also in communication through line 71. Therefore said pistons 61–68 take up most of the overturning moment, so that only a negligible fraction of it is discharged onto wheels 21, the duration and operational safety of which is consequently indefinitely prolonged. It must be noted that lines 70 and 71 permit pistons 61 to 68 to freely move the relevant pistons when the first set of pistons 60 is operated in order to lift, respectively lower turret 20.

As shown in FIG. 7, the piston rods of the hydraulic jacks 61–68 extend from opposite faces of the pistons. Consequently, each of the opposed faces of the pistons have equal surface areas and the system is symmetrical.

Figure 8:
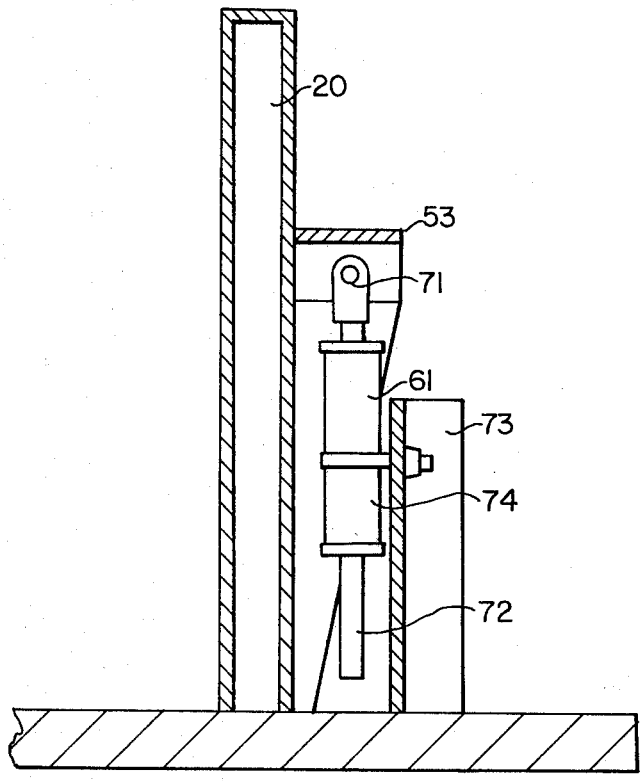
FIG. 8 illustrates a hydraulic piston of the second set connected to the turret of the present invention.

FIG. 8 shows the connection of hydraulic jack 61 to the turret 20. The hydraulic jack 61 may conveniently be attached to the turret 20 by attaching it to the annular flange 53 at 71. The piston rod 72 extends downward, and the body of the hydraulic jack 61 is attached to vertical support 73 by any convenient bracket 74.

What I claim is:

1. In a continuous casting apparatus having a vertically liftable turret, a pair of arms mounted on said turret for vertically lifting together with said turret and mounted for independent horizontal rotation on said turret, and means comprised of simple effect jacks for vertically lifting said turret, the combination comprising: a plurality of double effect hydraulic jacks each having a respective upper and lower chamber and disposed in diametrically opposed pairs around said turret and mounted for supporting said turret in a lifted condition; and means for interconnecting the lower chamber of each said double effect hydraulic jack to the upper chamber of the double effect hydraulic jack diametrically opposed thereto to define pairs of interconnected diametrically opposed jack pairs effective to compensate for eccentric loads applied to said turret.

2. In a continuous casting apparatus according to claim 1, wherein said double effect hydraulic jacks each comprise a piston and a piston rod extending from a pair of opposed faces of said piston to obtain equal surface areas of said pair of opposed piston faces.

* * * * *